US005491930A

United States Patent [19]

La See

[11] Patent Number: 5,491,930

[45] Date of Patent: Feb. 20, 1996

[54] ADJUSTABLE TRACK AND HINGE FOR CASEMENT WINDOWS

[76] Inventor: Jack C. La See, 308 W. Cedar St., Abbotsford, Wis. 54405

[21] Appl. No.: 372,415

[22] Filed: Jan. 13, 1995

[51] Int. Cl.[6] ..... E05D 15/30

[52] U.S. Cl. ..... 49/252; 49/396

[58] Field of Search ..... 49/252, 260, 396, 49/248, 249, 250, 246, 345, 346, 251; 16/235, DIG. 34

[56] References Cited

U.S. PATENT DOCUMENTS

| | | | |
|---|---|---|---|
| Re. 32,846 | 1/1989 | Sandberg et al. . | |
| 2,688,779 | 9/1954 | Westman | 49/252 |
| 4,674,149 | 6/1987 | Vetter . | |
| 4,726,092 | 2/1988 | Tacheny et al. . | |
| 4,790,106 | 12/1988 | La See | 49/252 |
| 4,833,759 | 5/1989 | Larsen . | |
| 4,986,028 | 1/1991 | Schneider et al. . | |
| 5,040,267 | 8/1991 | Dallmann | 49/252 X |
| 5,074,075 | 12/1991 | La See | 49/252 |
| 5,152,102 | 10/1992 | La See | 49/252 |

FOREIGN PATENT DOCUMENTS

| | | |
|---|---|---|
| 376488 | 7/1932 | United Kingdom . |
| 1137878 | 12/1968 | United Kingdom . |

*Primary Examiner*—Philip C. Kannan
*Attorney, Agent, or Firm*—Quarles & Brady

[57] ABSTRACT

A hinge and track assembly for casement windows corrects for sash sag by changing the length of one arm in a multiple lever arm system controlling the opening of the window. The length adjustment may be accomplished with an expansion joint removed from the pivot points of the arm permitting the use of a more robust design for one pivot point which may be integrally formed with the track. The arm may be retained on the integral pivot point with a spring clip fitting within the pivot and providing inwardly flexing detents.

7 Claims, 2 Drawing Sheets

ADJUSTABLE TRACK AND HINGE FOR CASEMENT WINDOWS

FIELD OF THE INVENTION

The invention relates to casement windows and, in particular, to a track and hinge assembly that may be adjusted to correct for sagging of the sash in such windows.

BACKGROUND OF THE INVENTION

Casement windows are those in which the window is opened by pivoting the sash about one edge of the sash in contrast to double hung windows, for example, in which the window is opened by a sliding of the sash along a track.

In one type of casement window, the bottom edge of the sash is supported on a long lever having one end pivotally mounted to a slider that may move left and right along a track. The track is attached to the sill (or opposing lintel) of the opening of the window. A second, short lever pivots about another fixed point on the track and is attached to the center of the first lever by a pivot. Opening of the sash causes a sliding inward of the effective axis about which the sash swings, the "sash axis" toward the center of the window opening, providing improved accessibility to both sides of the window.

One of the problems with casement windows is "sash sag" which can cause the lower swinging edge of the sash to strike the sill when the window is returned to the closed position. Sash sag may be caused by poor installation of the window unit causing the window opening into which the sash fits to no longer be square, or by poor hinge positioning by the window manufacturer.

One method of correcting for sash sag involves repositioning the hinges. U.S. Pat. No. 4,790,106 assigned to the same assignee as the present invention and hereby incorporated by reference, describes a cam system for moving the entire system track and hinge assembly of the casement window, left or right with respect to the window opening thereby aligning the sash axis with the window opening.

Alternatively, the need to move the entire track and hinge assembly with respect to the window opening may be avoided by changing the position of the pivot point at which the short lever (described above) is attached to the track. For a given angle of opening of the sash, a change in this pivot point will change the location of the slider on the track. Changing the location of the slider on the track changes the point about which the sash pivots allowing correction of the sash axis.

Cam systems for changing the pivot point of the short arm is described in U.S. Pat. Nos. 5,074,075 and 5,152,102 also assigned to the assignee of the present invention and incorporated by reference.

The pivot point attaching the short arm to the track must be rugged and capable of withstanding the forces generated by wind and in opening and closing the window. These forces are applied at varying angles and opposite directions depending on whether the window is being opened or closed.

Because the movement of pivot point to correct sash sag is small, an adjustable pivot point must be designed to resist slippage with use of the window. Nevertheless, the mechanism for adjusting the pivot point must be compact to fit within the normal width of the track and to be compatible with standard window openings. Further, it is desirable that the pivot point be readily adjusted without the need for special tools or significant disassembly of the window or hinge and track assembly. It is difficult to meet these requirements as well as to produce a mechanism that is durable, readily manufactured, and reasonable in cost.

SUMMARY OF THE INVENTION

The present invention recognizes that an alternative to adjusting the pivot point (of the short arm) to correct for sash sag is changing the length of the short arm itself. This change of length may be accomplished by an extension joint positioned on the short arm away from the pivot point providing space for the extension joint and permitting the pivot point to be simplified and made more rugged. Because the pivot point may now remain fixed, it may be formed integrally with the track thus increasing its strength and simplifying its manufacture.

Specifically, the present invention provides a track and hinge assembly set for use with a casement window sash unit mounted on the window frame of a building. The window frame has upper and lower horizontal frame members connected by vertical frame members, the track and hinge assembly has similar upper and lower track and hinge units, and each track and hinge unit includes an elongate horizontal track secured to one of the respective horizontal frame members.

Each track and hinge unit includes a hinge mechanism having a first and second pivotally interconnected link, the first link being connected to the sash unit and having one of its ends pivotably and slidably connected to the track, the second link having a first end pivotably connected to the first link and a second end pivotally connected to the track.

The second link has an extension joint permitting an increase in the separation of the first and second ends of the second link, such increase in separation serving to overcome sash sag.

Thus, it is a first object of the invention to provide an improved mechanism for overcoming sash sag that does not require movement of the track with respect to the window opening. Extending the length of the second link effectively changes the sash axis without moving the track or point at which the second link is attached to the track.

The second end of the second link may be pivotally attached to the track by means of a tubular pivot integrally formed from the track and extending upwardly from the track to fit within a hole in the second end of the second link. A retainer may hold the second link against any vertical force tending to move the second link off of the tubular pivot when the hole in the second end is received over the tubular pivot.

Thus, it is another object of the invention to provide a mechanism for reducing sash sag that permits a simple and robust pivot design. Because the extension joint of the second link may be displaced from the pivot point, the pivot construction is much simplified.

It is another object of the invention to provide a pivot design that may better resist the multi-directional forces applied by the second link to the pivot when the window is opened and closed. The tubular pivot may be drawn or forged out of the same material as the track making its attachment extremely strong. A spring clip fitting within the tubular pivot may be used to retain the short arm on the tubular pivot against the relatively small vertical forces that may dislodge it.

The extension joint may consist of a first and second overlapping plate held together by a clamp which may be released to change the overlap between the first and second plate thereby increasing the separation between the first and second ends of the short arm. The first and second plate may incorporate serrations interfitting when the first and second plate are held together by the clamp to prevent sliding of the first and second plate with respect to each other.

Thus, it is another object of the invention to provide a mechanism for changing the separation of the first and second ends of the short arm that is compact and well adapted to resist the longitudinal forces on the short arm. Serrations provide a primary resistance to forces on those arms both along its length and buckling forces transverse to its length so that the clamp need supply only a moderate amount of pressure.

The clamp may be provided by a machine screw having a threaded end fitting into a tapped hole in one of the first and second plates and passing through an oversized hole in the other of the first and second plates to clamp the other of the plates between a head of the machine screw and the other plate when the machine screw is advanced into the threaded hole.

Thus, it is yet another object of the invention to provide an adjustment mechanism for a hinge and track assembly on casement windows that may be adjusted with simple and readily available tools. A single machine screw can, with modest pressure in the present serrated design, prevent a slippage or buckling of the overlapping plates of the short arm.

The foregoing and other objects and advantages of the invention will appear from the following description. In the description, reference is made to the accompanying drawings which form a part hereof and in which there is shown by way of illustration, a preferred embodiment of the invention. Such embodiment does not necessarily represent the full scope of the invention, however, and reference must be made therefore to the claims herein for interpreting the scope of the invention.

DETAILED DESCRIPTION OF THE PREFERRED EMBODIMENT

Figure 1:
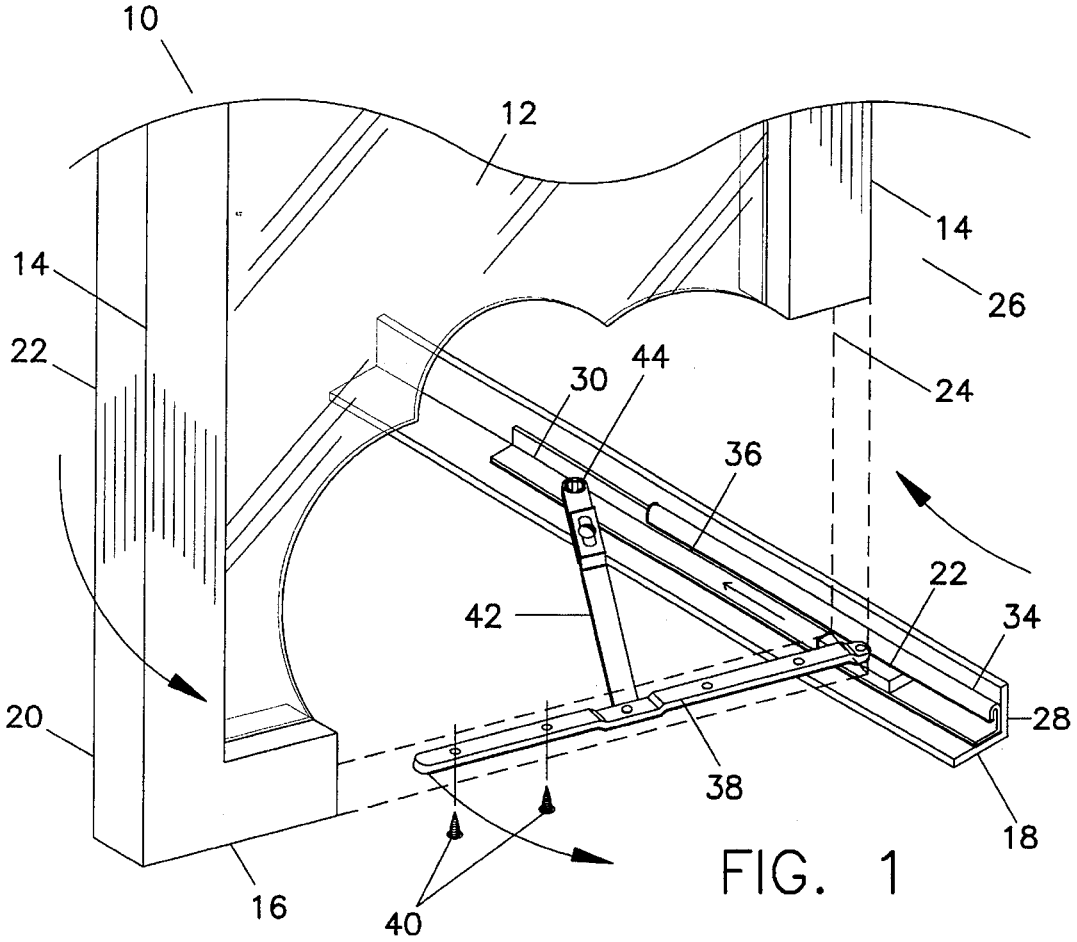
FIG. 1 is a perspective view in cutaway of the lower half of a window sash showing the attachment of the track and hinge assembly to the lower side of the sash and showing directions of motion of the sash as the window is opened.

Referring to FIG. 1, a window sash 10 may include a generally rectangular pane 12 surrounded by a frame having vertical styles 14 connected to top and bottom rails 16 (top rail 16 not shown).

When closed, the sash 10 fits within a window opening defined at its bottom edge by a sill 18. The sash 10 may be opened so that its outer edge 20 swings, as indicated by arrow 22, about a sash axis 24 passing vertically along the inner edge 26 of the sash 10.

Attached to the upper surface of the sill 18, abutting an upwardly extending stop 28 attached to the rear of the sill 18, is a track 30 aligned with the length of the sill 18. The track 30 supports on its upper surface a slide block 32 having a rearward flange captured by an overhang 34 of the track 30 at the rear of the track 30. The slide block 32 may slide generally in a direction 36 aligned with the length of the sill 18 from a point near an edge of the sill to a point midway along the track 30.

A sash arm 38 is at one end pivotally attached to the slide block 32 and is affixed, at points along its length, to the underside of the lower rail 16 of the sash 10, by means of wood screws 40. The pivoting of the sash arm 38 within a generally horizontal plane about the slide block 32 establishes the sash axis 24 previously described. As the slide block 32 travels along the track 30, the sash axis 24 moves with it.

A short arm 42 is attached at a pivot point 44 on the track 30, at an end opposite the position of the slide block 32 when the window is closed, so that the short arm 42 may swing in a generally horizontal plane about the pivot point 44. The other end of the short arm 42 is attached pivotally to a midpoint of the sash arm 38. The resulting linkage controls the position of the slide block 32 along the track 30 as a function of the angle to which the sash 10 is opened.

Initially, with the sash 10 closed, the slide block 32, and hence the sash axis 24, is positioned at one edge of the sill 18. As the sash 10 swings open, the sash arm 38 pivots about the end of short arm 42 moving the slide block 32 toward the pivot point 44 and thus moving the inner edge 26 of the sash 10 along the track 30 toward the center of the sill 18. This compound action causes the sash 10 to move toward the center of the sill as it opens providing access to both sides of the window such as may be desirable for cleaning or to avoid an obstruction in multiple window assemblies.

This track and hinge assembly, including the elements of the track 30, the sash arm 38, the short arm 42, and the slide block 32, is duplicated with mirror symmetry at the top of the sash 10 so as to support the upper style of the sash 10 (not shown) and so that the axes of pivoting of the sash arms about the slide blocks are both aligned with the sash axis 24 for coordinated movement as the sash 10 is opened. For simplicity, only the track and hinge assembly associated with the lower portion of the sash 10 is described and depicted, however, it will be understood that this disclosure applies equally to the hinge and track assembly supporting the top of the sash 10.

Figure 2:
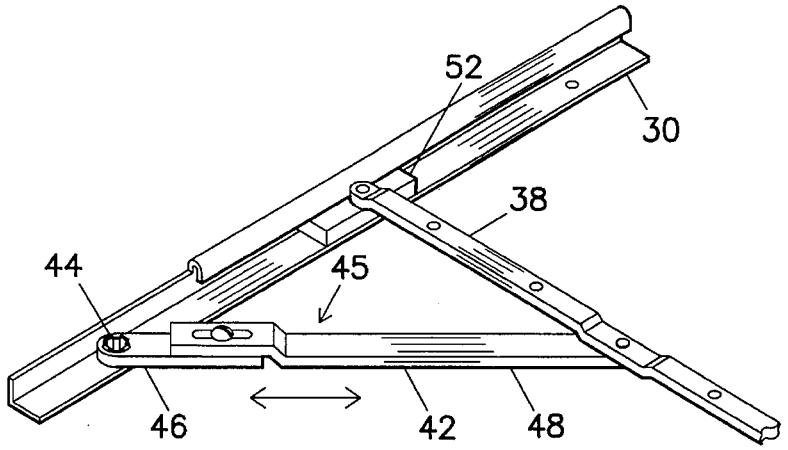
FIG. 2 is a view in detail of the track and hinge assembly of FIG. 1 showing the connection of the sash arm to the sash and the short arm to the midpoint of the sash arm and showing an extension joint on the short arm.
Figure 3:
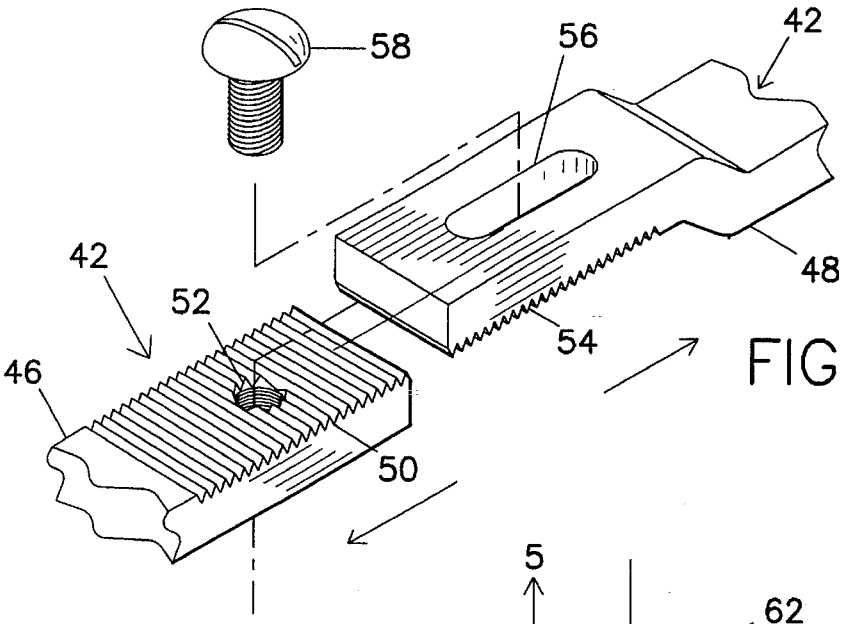
FIG. 3 is an exploded, perspective view of the expansion joint of FIG. 2 showing the serrations used to resist buckling and sliding of the expansion joint.

Referring now to FIGS. 2 and 3, the short arm 42 is constructed of two pieces, a track portion 46 having one end pivotably attached to the pivot point 44, and a sash portion 48 having one end pivotally attached to the midpoint of the sash arm 38. The remaining ends of the sash portion 48 and the track portion 46 overlap each other to form an extension joint 45.

Specifically, the extension joint 45 is formed by the interface between an upper face of the track portion 46 of the short arm 42 where it overlaps with a lower face of sash portion 48. Each of these overlapping faces is cut with transversely extending V-channels forming serrations 50 and 54 which interfit when the overlapping faces abut at a variety of different degrees of overlap which provide different lengths of the short arm 42.

A tapped hole 52 extends vertically through the region of serrations 50 into the track portion 46 of the short arm 42. Similarly, the serrations 54 of the sash portion 48 of the short arm 42 is pierced by a slot 56 extending in a longitudinal direction and sized to receive the shaft of a machine screw 58 when the threaded shaft of the machine screw 58 is inserted downward through the slot 56 and received by the tapped hole 52.

Tightening of the machine screw 58 into the tapped hole B2 clamps the portions 48 and 46 together. The meshing of the serrations 50 and 54 prevents slippage and buckling of the short arm 42 within the horizontal plane. Thus, the clamping pressure exerted by the machine screw 58 need only be sufficient to hold the serrations 50 and 54 in engagement—the forces acting on the short arm 42 are resisted by the intermeshing of these serrations.

For this reason, the machine screw 58 may be tightened, and loosened with the torque that may be applied by a standard screwdriver, permitting the adjustment of the length of the short arm 42 without special tools.

Figure 4:
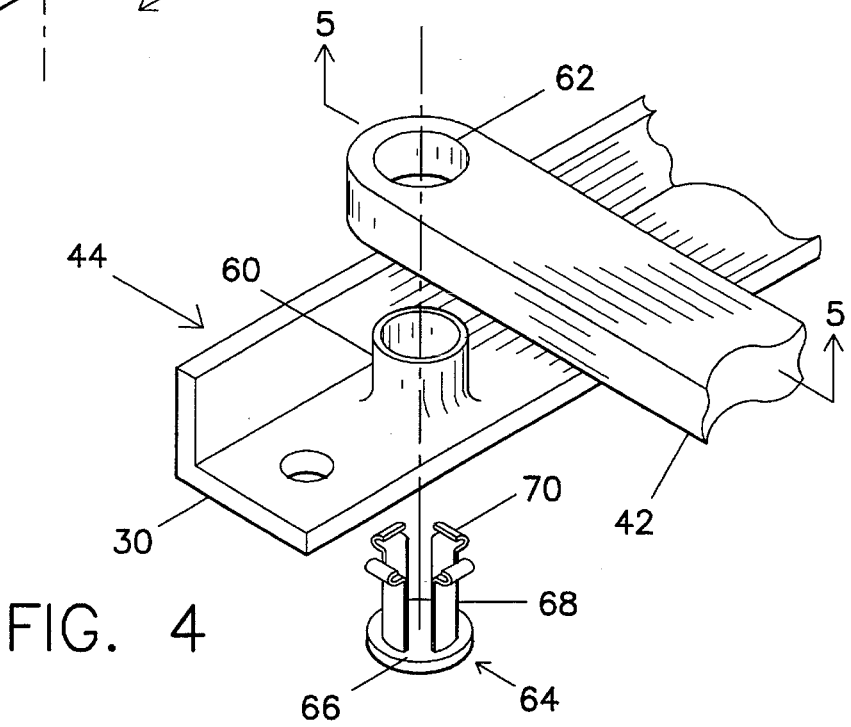
FIG. 4 is an exploded, perspective view of the pivotal attachment of the short arm to the track of FIG. 2 showing the integral connection of the pivot point, the track.

Referring now to FIG. 4, the displacement of the adjusting mechanism for sash sag out onto the short arm 42 and away from the pivot point 44 permits construction of the pivot point 44 to be simplified. In the preferred embodiment, the pivot point 44 is a tubular pivot 60 formed integrally with the track 30 and extending upward therefrom. Such a tubular pivot 60 may be generated through the use of a punch and die which extrudes the material of the track 30 into the desired upstanding tubular wall.

Figure 5:
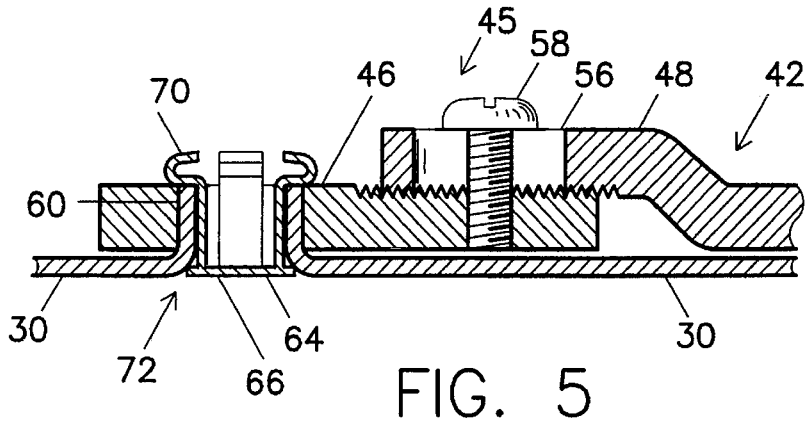
FIG. 5 is a cross-sectional view along line 5—5 of FIG. 4 showing the retention of the short arm to the pivot point by means of a spring clip.

The outer diameter of the tubular pivot 60 is such as to permit a hole 62 in the end of the short arm 42 to fit around the pivot 60 to freely turn thereon. Referring also to FIG. 5, the walls of the tubular pivot 60 are generally vertical and thus horizontal forces exerted on the pivot 60 by the short arm 42 do not tend to disengage the short arm 42 from the pivot 60. For this reason, only a light retaining force is necessary to hold the short arm 42 on the tubular pivot 60 in normal use.

This restraining force is provided by a spring clip 64 having a generally cylindrical head 66 with four upstanding fingers 68 arranged about the periphery of the head 66 to form a generally cylindrical volume. The upper extent of the fingers 68 include radially outward extending detents which may be pressed inward by flexing the fingers 68 inward. The spring clip 64 may be inserted from beneath the track 30 so that the fingers 68 extend upward through the inside of the tubular pivot 60, first compressing inward to let the detents 70 pass through the tubular pivot 60 and then flexing outward to allow the detent 70 to extend over the top of the tubular pivot 60 where they hold the short arm 42 on tubular pivot 60 when the two are assembled together.

The tubular pivot 60 attaches to the track 30 at a counter sink area 72 so that the head 66 may press upward flush against the bottom surface of the track 30 and not interfere with installation of the track 30 on the sill 18.

The integral pivot 60 so formed is substantially stronger than pivots which must be separately attached to the track 30. The use of an integral pivot also simplifies the construction of the track and hinge assembly by eliminating a part.

After assembly of the pivot 60 and the short arm 42, compression of the fingers of the spring clip 64 inward permit removal of the short arm 42 from the pivot 60 for adjustment of the extension joint 45 with greater ease.

The above description has been that of a preferred embodiment of the present invention. It will occur to those that practice the art that many modifications may be made without departing from the spirit and scope of the invention. In order to apprise the public of the various embodiments that may fall within the scope of the invention, the following claims are made.

I claim:

1. A track and hinge assembly set for use with a casement window sash unit mounted on a window frame of a building, the window frame including upper and lower horizontal frame members connected by vertical frame members, the track and hinge assembly comprising similar upper and lower track and hinge units, each track and hinge unit including an elongate horizontal track secured to one of the respective horizontal frame members, each track and hinge unit including a hinge mechanism with first and second pivotally interconnected links, the first link being connected to the sash unit and having one of its ends pivotally and slidably connected to the track, the second link having a first and second end with the first end pivotally connected to the first link;

a tubular pivot integrally formed from the track and extending upwardly from the track to fit within a hole in the second end of the second link thereby pivotally attaching the second end of the second link to the track; and retaining means for retaining the second end of the second link against vertical motion off of the tubular pivot when the tubular pivot is received within the hole in the second end.

2. The track and hinge assembly set of claim 1 wherein the retaining means is a spring clip having multiple fingers extending upward from a head to define a cylindrical volume that may be received within the tubular pivot with upper ends of the fingers having radially outward extending detents that may be moved inward against flexure of the fingers, wherein the spring clip may be inserted within the tubular pivot with the detents extending radially outward along an upper edge of the tubular pivot to retain the second link against vertical motion off of the tubular pivot when the tubular pivot is received within the hole in the second end.

3. The track and hinge assembly set of claim 2 wherein a bottom surface of the track beneath the tubular pivot is countersunk to permit the head of the spring clip to lie flush with a bottom surface of the track when the head of the spring clip abuts the bottom of the tubular pivot.

4. A track and hinge assembly set for use with a casement window sash unit mounted on a window frame of a building, the window frame including upper and lower horizontal frame members connected by vertical frame members, the track and hinge assembly comprising similar upper and lower track and hinge units, each track and hinge unit including an elongate horizontal track secured to one of the respective horizontal frame members, each track and hinge unit including a hinge mechanism with first and second pivotally interconnected links, the first link being connected to the sash unit and having one of its ends pivotally and slidably connected to the track, the second link having a first and second end with the first end pivotally connected to the first link;

the second link further having an extension joint positioned between the first and second ends permitting an increase in the separation of the first and second ends;

a tubular pivot integrally formed from the track and extending upwardly from the track to fit within a hole in the second end of the second link thereby pivotally attaching the second end of the second link to the track; and retaining means for retaining the second end of the second link against vertical motion off of the tubular pivot when the tubular pivot is received within the hole in the second end.

5. The track and hinge assembly set of claim 4 wherein the retaining means is a spring clip having multiple fingers extending upward from a head to define a cylindrical volume that may be received within the tubular pivot with upper ends of the fingers having radially outward extending detents that may be moved inward against flexure of the fingers, wherein the spring clip may be inserted within the tubular pivot with the detents extending radially outward along an upper edge of the tubular pivot to retain the second link against vertical motion off of the tubular pivot when the tubular pivot is received within the hole in the second end.

6. In a track and hinge assembly set for use with a casement window sash unit mounted on a window frame of a building, the window frame including upper and lower horizontal frame members connected by vertical frame members, the track and hinge assembly comprising similar upper and lower track and hinge units, each track and hinge unit including an elongate horizontal track secured to one of the respective horizontal frame members and each track and hinge unit including a hinge mechanism including first and second pivotally interconnected links, the first link being connected to the window sash unit and having one of its ends pivotally and slidably connected to the track, the second link having a first and second end with the first end pivotally connected to the first link, a track pivot pivotally connecting the second end of the second link to the track, the track pivot comprising:

a tubular pivot extending upwardly from the track to fit within a hole in the second end of the second link thereby pivotally attaching the second end of the second link to the track; and a spring clip having multiple fingers extending upward from a head that may be received within the tubular pivot, with upper ends of the fingers having radially outward extending detents that may be moved inward against flexure of the fingers, wherein the spring clip may be inserted within the tubular pivot with the detents extending radially outward along an upper edge of the tubular pivot to retain the second link against vertical motion off of the tubular pivot when the tubular pivot is received within the hole in the second end.

7. A track and hinge assembly set for use with a casement window sash unit mounted on a window frame of a building, the window frame including upper and lower horizontal frame members connected by vertical frame members, the track and hinge assembly comprising similar upper and lower track and hinge units, each track and hinge unit including an elongate horizontal track secured to one of the respective horizontal frame members, each track and hinge unit including a hinge mechanism with first and second pivotally interconnected links, the first link being connected to the sash unit and having one of its ends pivotally and slidably connected to the track, the second link having a first and second end with the first end pivotally connected to the first link;

a tubular pivot integrally formed from the track and extending upwardly from the track to fit within a hole in the second end of the second link thereby pivotally attaching the second end of the second link to the track; and a retaining clip inserted in the tubular pivot and retaining the second end of the second link against vertical motion off of the tubular pivot.

* * * * *